United States Patent [19]

Harmon

[11] 3,985,202

[45] Oct. 12, 1976

[54] HYDRAULICALLY OPERATED DISAPPEARING STAIRWAY

[75] Inventor: Paul V. Harmon, Nashville, Tenn.

[73] Assignee: Precision Parts Corporation, Nashville, Tenn.

[22] Filed: June 23, 1975

[21] Appl. No.: 589,551

[52] U.S. Cl. ..... 182/79; 182/106

[51] Int. Cl.[2] ..... E04F 11/04; A62B 1/06

[58] Field of Search ..... 182/78, 79, 80, 97, 182/208, 86, 106

[56] References Cited

UNITED STATES PATENTS

| | | | |
|---|---|---|---|
| 2,931,456 | 4/1960 | Harmon | 182/80 |
| 3,196,981 | 7/1965 | Winnall | 182/208 |
| 3,774,720 | 11/1973 | Hovey | 182/208 |

*Primary Examiner*—Reinaldo P. Machado
*Attorney, Agent, or Firm*—John X. Phillips

[57] ABSTRACT

A unitary stairway (as distinguished from a sectional folding stairway) is adapted to assume an inclined operative position and an upper horizontal inoperative position above the ceiling of the room. Hydraulic means imparts longitudinal forces to the stairway to move it upwardly or downwardly, and rails carried by the stairway are engageable in guide rollers to guide the stairway between operative and inoperative positions. A wall switch is operable to energize a motor for driving a pump to generate power in the hydraulic means.

7 Claims, 6 Drawing Figures

HYDRAULICALLY OPERATED DISAPPEARING STAIRWAY

CROSS REFERENCE TO ISSUED PATENT

Reference is made to applicant's prior U.S. Pat. No. 2,931,456, granted Apr. 5, 1960. In such prior patent, an electric motor provides the power for moving the stairway between operative and inoperative positions, and chain and cable means are employed for transmitting movement from the motor to the stairway. The same guide rollers and rails are employed for guiding the stairway between operative and inoperative positions, as referred to above.

SUMMARY OF THE INVENTION

The invention comprises a stairway formed of spaced parallel side runners and steps connected therebetween, and the stairway moves within a framed opening in the ceiling. The framing of the opening carries a transverse roller which supports the stair runners in the movement of the stairway between operative and inoperative positions. A pair of concavely grooved rollers are rotatably supported by a pivoted plate to rock therewith to assume different positions in engagement with a rail connected at its upper end to each of the runners and at its lower end to such runners so that the movement of the stairway between its two positions will be guided. Hydraulic power means is mounted beneath the stairway. This power means comprises two side-by-side hydraulic cylinders, each having a piston provided with a piston rod, and the piston rods of the two hydraulic cylinders project in opposite directions. One piston rod has its free end pivotally connected to a bearing bracket connected to a cross member of the framing of the opening, while the free end of the other piston rod is pivotally connected to the stairway adjacent its lower end.

An electric motor drives a pump to supply hydraulic pressure to the cylinders and fluid is returned from the cylinders to a reservoir connected to the intake side of the pump. The two cylinders have opposite ends thereof connected by suitable piping so that when fluid is supplied by the pump to one end of one cylinder, such fluid automatically flows to the opposite end of the other cylinder. When one piston rod is moved from its cylinder, therefore, the other piston rod is similarly moved in the opposite direction, thus exerting pushing forces between the frame and the bottom of the stairway to move the stairway to its angular operative position. When fluid is admitted to the other ends of the cylinders, the pistons are oppositely retracted to exert a pulling force on the lower end of the stairway to move it to its upper inoperative position. The cylinders are fixed with respect to each other but are not fixed to the stairway, and the flow of hydraulic fluid to and from the cylinders is controlled by electrically operated valves.

DESCRIPTION OF THE PREFERRED EMBODIMENT

Figures 1, 3, 4:
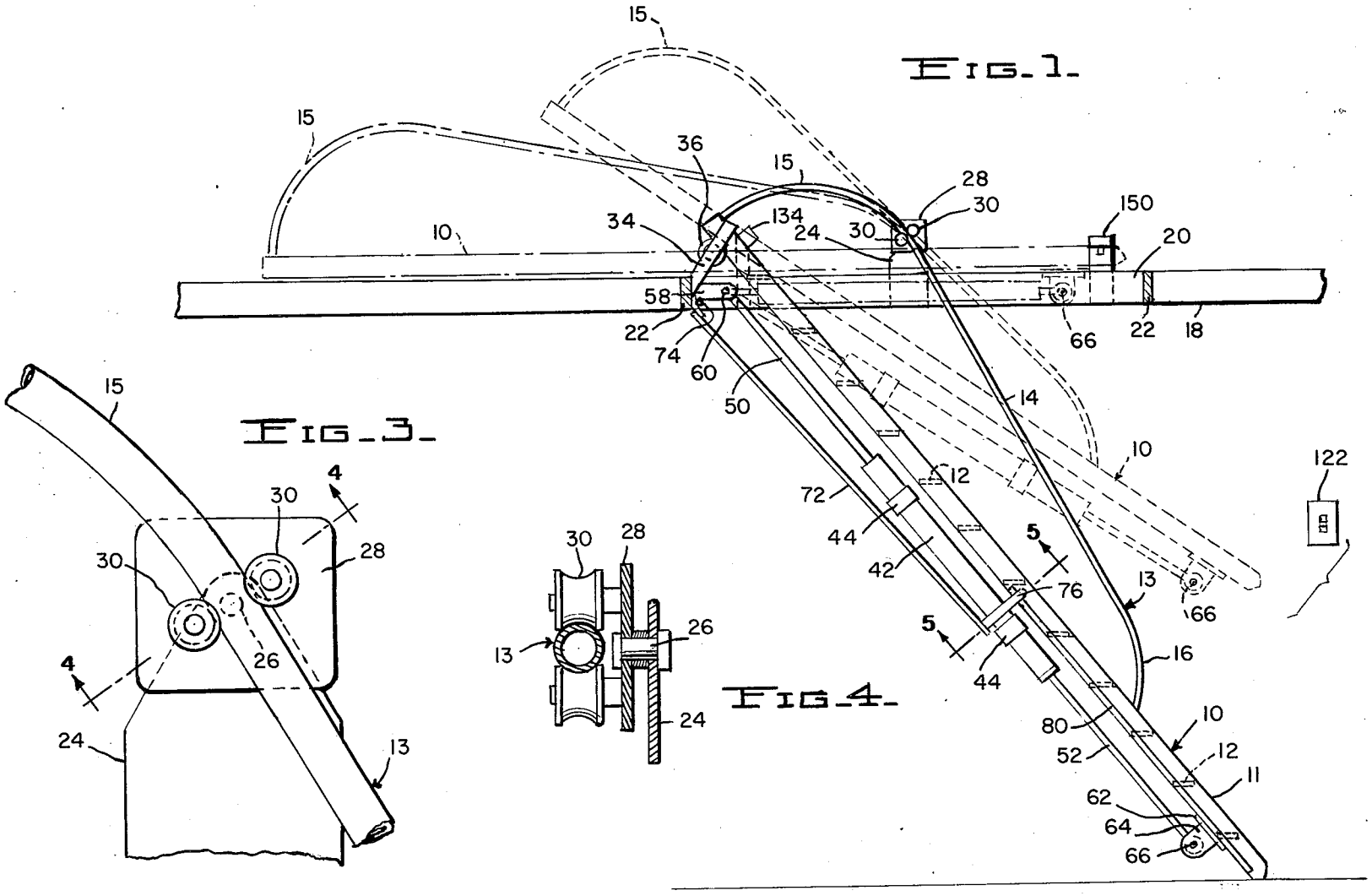
FIG. 1 is a side elevation of the stairway shown in solid lines in its operative position and in its relationship to the framed ceiling opening, the transverse members of which are shown in section.
FIG. 3 is a fragmentary enlarged elevation of a portion of one of the guide rails and the associated rollers which guide the rails to guide the movement of the stairway.
FIG. 4 is a fragmentary detailed sectional view on line 4—4 of FIG. 3.
Figure 2:
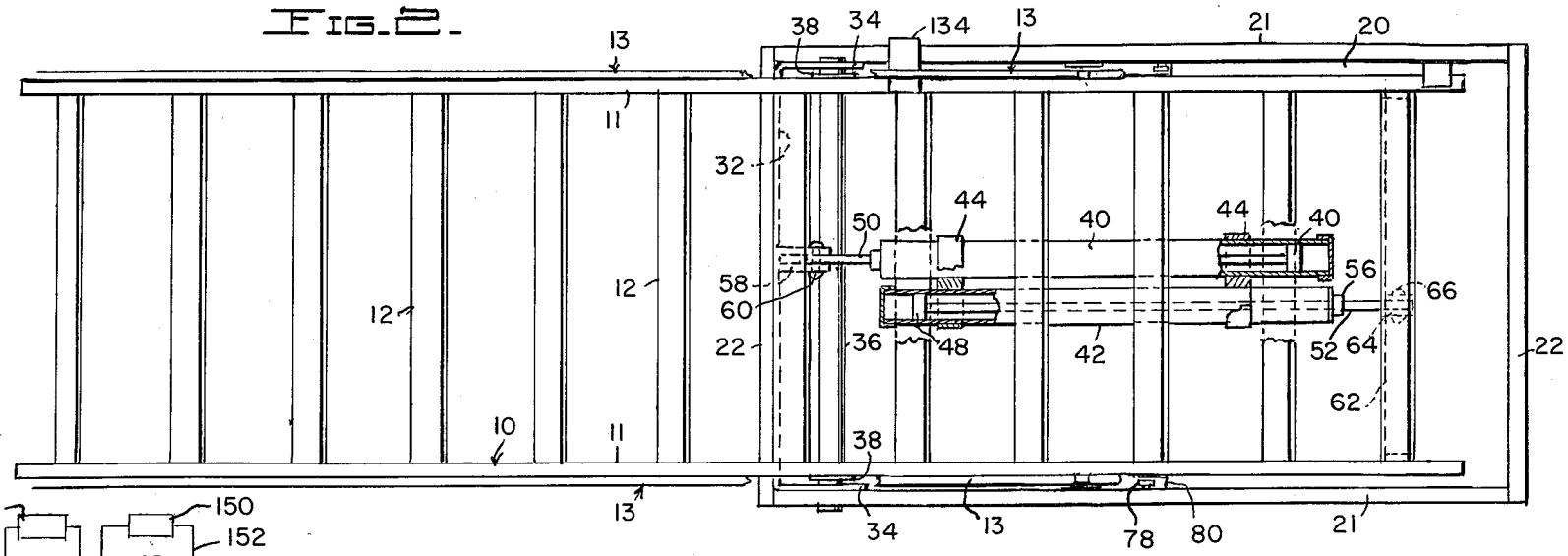
FIG. 2 is a plan view of the stairway shown in its upper horizontal inoperative position and showing the ceiling opening.

Referring to FIGS. 1 and 2, numeral 10 designates the stairway as a whole comprising spaced parallel side runners 11 connected by steps 12. The stairway is provided at opposite sides with guide rails 13, which also function as handrails. Each guide rail is provided with a straight intermediate section 14 curved at its upper end on a substantial radius as at 15 and at its lower end, a curved section 16 is provided. The extremities of the curve rail sections are fixed to the runners 11.

The ceiling structure 18 of the room is provided with an opening 20 through which the stairway is adapted to move and this opening is formed by a frame structure including longitudinal members 21 and transverse members 22. A bracket 24 is secured against each frame member 21 and is provided with a pin 26 pivotally supporting a plate 28, carrying a pair of concavely grooved rollers 30 between which the associated guide rail 13 is adapted to move. The pivoting of the plates 28 allows them to adjust themselves to the angularity of the rails 13 as the stairway moves between operative and inoperative positions. This will be apparent from FIG. 1 in which an intermediate position of the stairway 10 is shown in dotted lines and an upper inoperative position is shown in broken lines.

Referring to FIG. 2, a plate 32 is fixed to one of the transverse members 22 and carries upwardly and inwardly projecting end members 34 rotatably supporting a roller 36, each end portion of which is flanged as at 38. The roller 36 supports the stairway in its movement between its two positions and the stairway is properly guided by the flange 38.

Beneath the stairway is arranged a pair of hydraulic cylinders 40 and 42 (FIGS. 2 and 6) fixed together by suitable clamps 44. These cylinders are respectively provided with pistons 46 and 48, and these pistons, in turn, are respectively provided with piston rods 50 and 52. The piston rod 50 projects through a bearing 54 in one end of the associated cylinder 40 while the piston rod 52 projects through the similar bearing 56 carried by one end of its associated cylinder 42.

The plate 32 carries ears 58 pivotally connected as at 60 to the extremity of the piston rod 50. A plate 62 (FIGS. 1 and 2) is connected between the stair runners 11 and is provided with depending ears 64 pivotally connected as at 66 to the extremity of the piston rod 52. Referring to the diagrammatic drawing in FIG. 6, it will be seen that a pipe 68 connects the ends of the cylinders 40 and 42 opposite the pivotal connections 60 and 66. A similar pipe 70 connects the other ends of the hydraulic cylinders. Thus it will be seen that if fluid is admitted to the left hand end of cylinder 42 in FIG. 2, it also will be admitted to the right hand end of cylinder 40. This will cause the pistons 46 and 48 to move respectively to the left and right to exert a force on the stairway to cause it to move to the right in FIG. 2. Similarly, if fluid is admitted to the left hand end of cylinder 40, the fluid will be admitted to the right hand end of cylinder 42 to exert a pulling force on the right hand end of the stairway in FIGS. 1 and 2 to move the stairway to its inoperative position.

Figure 5:
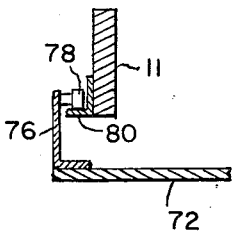
FIG. 5 is a fragmentary detailed sectional view on line 5—5 of FIG. 1.

A door for the ceiling opening 20 is provided and indicated at 72 (FIG. 1). This door is pivoted as at 74 to the adjacent plate 32. Adjacent opposite sides of its free end, the door is provided with upstanding arms 76 (FIGS. 1 and 5), each carrying at its upper end a roller 78 engaging an elongated angle plate 80 fixed to the associated runner 11. The rollers 78 travel relatively upwardly along the track 80 as the stair is lowered and relatively downwardly as the stair is moved to inoperative position to close the opening 20.

Figure 6:
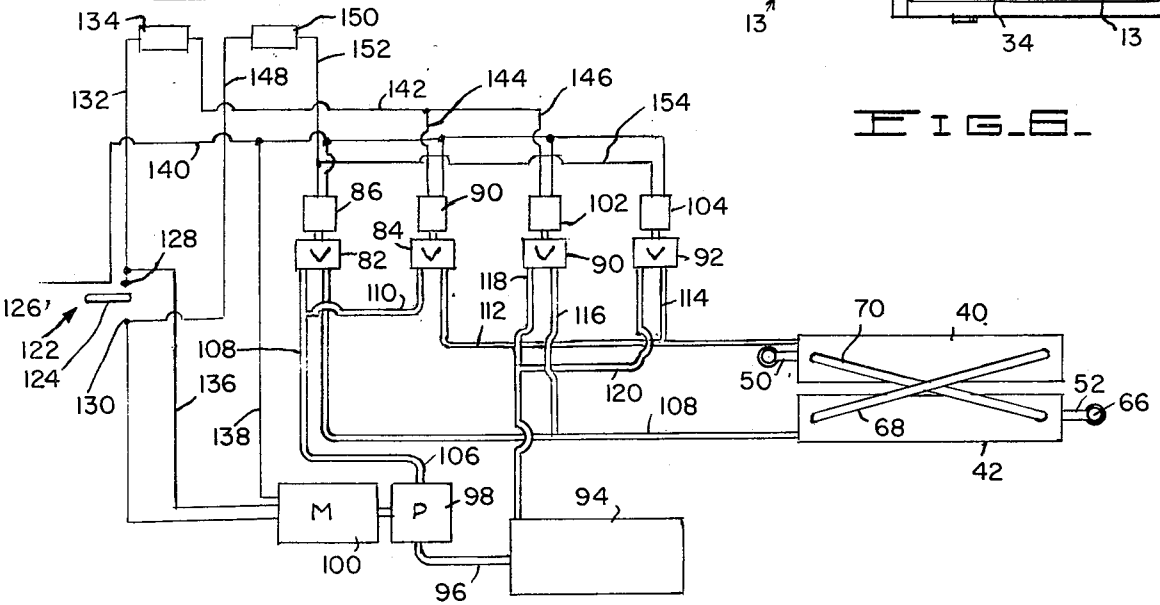
FIG. 6 is a diagrammatic view of the wiring and hydraulic connections for the structure.

In FIG. 6, there is illustrated in simplified form, a wiring and piping diagram for the stairway. A pair of inlet valves 82 and 84 control the admission of fluid to the cylinders 40 and 42 and solenoids 86 and 88, respectively, control these valves. Relief valves 90 and 92 control the flow of fluid from the cylinders 40 and 42 back to a reservoir 94 having a pipe 96 leading to the intake side of pump 98 driven by a motor 100. The valves 90 and 92 are operated by solenoids 102 and 104, respectively.

The pump 98 has its outlet connected by a pipe 106 to the inlet valve 82 and such valve has a pipe 108 leading to the left hand end of the cylinder 42 as viewed in FIG. 6. The pipe 106 is also connected by a pipe 110 to the inlet valve 84 from which a pipe 112 leads to the left hand end of the cylinder 40. The valve 92, which is one of the fluid pressure relief valves, is piped as at 114 to the pipe 112. The second pressure relief valve 90 is connected by a pipe 116 to the pipe 108 and is also connected by a pipe 118 to the reservoir 94. The outlet of the valve 92 is connected as at 120 to the pipe 118.

A two-way switch 122 controls the motor 100 and the various solenoids described. This switch comprises an arm 124 connected to a current source as at 126 and movable selectively into engagement with contacts 128 and 130. The contact 128 is connected by a wire 132 to a limit switch 134 which controls upward movement of the stairway from operative to inoperative position. The wire 132 is connected as at 136 to the motor 100 and this motor is connected as at 138 to a wire 140 connected to the other side of the source. The second terminal of the switch 134 is connected to a wire 142, which wire is connected as at 144 and 146 to the respective solenoids 88 and 102.

The contact 130 is connected as at 148 to a second limit switch 150 which controls downward movement of the stairway. The other terminal of the switch 150 is connected by a wire 152 to the solenoid 86 and the wire 152 has a lead 154 connected to the solenoid 104. The other terminals of all of the solenoids are connected to the wire 140, as shown.

OPERATION

Assuming that the stairway is in the horizontal normal position shown in FIG. 2 and in broken lines in FIG. 1, and it is desired to lower the stairway, the two-way switch 122 will be operated by moving the switch arm 124 downwardly into engagement with the contact 130. Current will flow through switch 150 to solenoids 86 and 104 to open the valves 82 and 92. The pump 98 will now supply fluid through pipe 108 and valve 82 and through pipe 108 to the left-hand end of the cylinder 42 as viewed in FIG. 6. Fluid thus supplied to the cylinder 42 will flow through pipe 68 to the right-hand end of the cylinder 40 thus moving the piston 48 of cylinder 42 to the right and piston 46 of motor 40 to the left. This obviously exerts a pushing force on the plate 62 and thus to the right-hand end of the stairway as viewed in FIG. 1. The stairway thus will be moved to the right and its movement will be guided by engagement of the rails 13 with the rollers 30. The angularity of the rails will change during such movement and such change in angularity is permitted by the rocking movement of the plate 28. When the stair reaches its lower position, the circuit will be broken at the switch 134 and the motor stopped.

It will be apparent that the movement of the hydraulic pistons as described will displace fluid from the right-hand end of the cylinder 42 and from the left-hand end of the cylinder 40. Fluid from the right-hand end of the cylinder 42 will flow through pipe 70 into the left-hand end of cylinder 40, from which the fluid will be displaced through pipes 112 and 114. The relief valve 92 being open, the fluid will flow back to the reservoir through pipes 120 and 118. During this operation, it will be obvious that both valves 84 and 90 will be closed.

When it is desired to return the stairway to its upper inoperative position, the switch arm 124 will be moved into engagement with the contact 128 to energize the motor, and through limit switch 134, and wires 142, 144, and 146 to energize the solenoids 88 and 102. The solenoids 86 and 104 will remain deenergized. Pumped fluid will then pass through pipes 108 and 110 and through valve 84 and pipe 112 to the left-hand end of the cylinder 40, which is connected by pipe 70 to the right-hand end of the cylinder 42. Both of the hydraulic pistons and their rods will now be retracted to exert an endwise pull on the lower end of the stairway, causing it to move upwardly while its movement is guided by engagement of the rails 13 with the rollers 30.

The retractile movement of the hydraulic pistons will displace fluid from the right-hand end of the cylinder 40 through pipe 68 to the left-hand end of the cylinder 42, which will now be connected to the reservoir through pipes 108 and 116, valve 90, and pipe 118. This movement continues until the stairway reaches normal inoperative position, whereupon operation of the limit switch 134 will break the circuits through the motor 100 and solenoids 88 and 102.

The wiring diagram has been made as simple as possible merely to give an understanding of the operation of the system as a whole. The limit switches form no part of the present invention and accordingly have not been illustrated in detail.

It will be apparent that the great change in the distance between the pivot points 60 and 66 in the movement of the stairway between its two positions is such that a single hydraulic cylinder cannot be used. Hence the use of two hydraulic cylinders with the interconnection thereof by the pipes 68 and 70. Thus the sum of the movements of the hydraulic pistons and piston rods provides the total movement necessary for moving the stairway between operative and inoperative positions.

The present construction is advantageious over the structure disclosed in my prior patent identified above. In the first place, the present construction eliminates the cables, pulleys, etc. of the prior construction, and accordingly is easier and more economical to manufacture. Many stairways constructed in accordance with the prior patent have been sold, and while there has never been a known failure of any of the cables, there is a remote possibility that this may occur, particularly after many years of use of the stairways. The present construction eliminates even a remote possibility of the failure of any of the parts due to the simple mechanical construction and the incompressibility of the hydraulic fluid. Accordingly, the present construction should last for many trouble-free years.

I claim:

1. A disappearing stairway structure comprising an open frame adapted to be mounted in a ceiling, a unitary stairway movable between an inoperative position extending from said frame to the floor below and a substantially horizontal inoperative position above and adjacent said frame, hydraulically operable means for transmitting endwise forces to said stairway, said hydraulic means comprising a pair of cylinders fixed to each other beneath the stairway, a piston in each cylinder, piston rods connected to said pistons and projecting from opposite ends of said cylinders, one of said piston rods having its free end connected to said frame and the other piston rod having its free end connected to said stairway adjacent the lower end thereof, means on which said stairway rests as it is moved between said two positions, guiding means carried by said frame, a hand rail carried by said stairway and engaging said guiding means throughout movement of said stairway between said two positions, and means for controlling said hydraulic means to relatively push said stairway in movement thereof from its inoperative position to its operative position, and for exerting a pull on said stairway endwise thereof to move said stairway from said operative to said inoperative position.

2. A structure according to claim 1 wherein the means for controlling said hydraulic means comprises inlet valve means for supplying hydraulic fluid selectively to opposite ends of the respective cylinders, and outlet valve means for exhausting fluid simultaneously from the other ends of said cylinders.

3. A structure according to claim 2 wherein said cylinders are arranged beneath and in proximity to said stairway and are wholly free from connection therewith, the free ends of said piston rods having pivotal connection with said frame and with said stairway whereby said cylinders are free to assume slightly different angles relative to said stairway as the latter moves between said two positions.

4. A structure according to claim 3 wherein each cylinder has one end fluid connected to the opposite end of the other cylinder so that the fluid supplied to one end of either cylinder will be communicated to the opposite end of the other cylinder, and whereby the exhaustion of fluid from either end of either cylinder will exhaust it from the opposite end of the other cylinder.

5. A structure according to claim 4 provided with a motor driven pump having an inlet and outlet, a reservoir connected to said inlet, said means for controlling said hydraulic means comprising electromagnetically controlled inlet valves controlling the flow of fluid from said pump outlet, and electrically controlled relief valves for controlling the return of fluid from said hydraulic means to said reservoir.

6. A structure according to claim 4 provided with a motor driven pump having an inlet and an outlet, and a reservoir connected to said inlet, said inlet valve means comprising a pair of electromagnetically controlled inlet valves controlling the supply of fluid from said pump outlet respectively to one end of each cylinder, said outlet valve means comprising a pair of electromagnetically controlled valves connected respectively between one end of each cylinder and said reservoir.

7. A disappearing stairway structure comprising an open frame adapted to be mounted in the ceiling, a unitary stairway movable between an operative position extending from said frame to the floor below and a substantially horizontal inoperative position above and adjacent said frame, means comprising a pair of oppositely extending parallel pressure operable piston rods connected respectively to said frame and to said stairway adjacent the lower ends of the ladder, means on which said stairway rests as it is moved between said two positions, guiding means carried by said frame, a hand rail carried by said stairway and engaging said guiding means throughout movement of said stairway between said two positions, and means for applying pressure to said pistons for moving them away from each other to push said stairway for movement thereof from its inoperative position to its operative position and for moving said pistons toward each other to exert a pull on the stairway to move it from its operative position to its inoperative position.

* * * * *